United States Patent [19]

Kekish

[11] 4,147,539

[45] Apr. 3, 1979

[54] PREPARATION OF CUPOLA FLUX

[75] Inventor: George T. Kekish, Chicago, Ill.

[73] Assignee: Nalco Chemical Company, Oak Brook, Ill.

[21] Appl. No.: 868,786

[22] Filed: Jan. 12, 1978

[51] Int. Cl.[2] ..... C21B 5/04

[52] U.S. Cl. ..... 75/257; 75/30

[58] Field of Search ..... 75/30, 257

[56] References Cited

U.S. PATENT DOCUMENTS

| | | | |
|---|---|---|---|
| 3,309,196 | 3/1967 | Kaneko et al. | 75/257 |
| 3,721,547 | 3/1973 | Dvorak et al. | 75/30 |

*Primary Examiner*—M. J. Andrews

*Attorney, Agent, or Firm*—John G. Premo; Robert A. Miller

[57] ABSTRACT

A flux for fluidizing slag in a cupola comprising a briquette which is composed of a major portion of alumina and an alkali metal base in an amount to provide an $Al_2O_3$:$Na_2O$ ratio ranging from 1:0.4 to 1:0.8 and from 5 up to 50% by weight of a binder from the group consisting of a montmorillonite clay, alumino silicate zeolites, sodium aluminate and aluminum phosphate. The briquette is characterized as being able to substantially maintain its physical integrity at about 1000° C. for about 1 hour.

4 Claims, No Drawings

PREPARATION OF CUPOLA FLUX

INTRODUCTION

The cupola resembles a miniature blast furnace. The cupola is a vertical steel shaft lined with refractory material such as silica, fire clay or equivalent, equipped with air ports at the bottom and a charging hole at the upper section for introducing the raw materials. Below the air ports or tuyeres is a section called the well from the bottom of which, through the tap hole, the molten metal is drawn, slag is removed either from the top of the well just below the tuyers or in a forehearth outside and in front of the cupola.

It differs from a blast furnace primarily in that pig iron and steel scrap replace an iron ore charge. The cupola is used in remelting and refining metals as distinguished from the characteristic processes of the blast furnace of winning metals from their ores or reducing ores. In a typical cupola, a charge is composed of coke, steel scrap and pig iron in alternate layers of metal and coke. Sufficient limestone, or other fluxing material, is added to flux the ash from the coke and form a slag. However, in many cupola operations, the fluxing effect of this limestone may be insufficient to insure satisfactory cupola operation. The ratio of coke to metallics varies, depending on the melting point of the metallic charge. Ordinarily, the coke will be about 6 to 12 percent of the weight of the metallic charge. It is kept as low as possible for the sake of economy and to exclude sulfur and some phosphorus absorption by the metal.

Initially, heat for the process is supplied by a bed of coke on top of which are placed alternate layers of iron and coke. Air introduced through the tuyeres burns the coke and the hot gases ascend through the upper charges of metal. Coke is consumed and the heat released to the metal. The process is one of countercurrent flow, the heat and gases rising upwards and out the top of the stack while the metal descends and is withdrawn from the bottom of the well.

During the operation of the cupola, non-metallic materials are produced from various sources. These materials arise from the ash in the coke, are eroded from the cupola lining or are contained on the surface of or internally from the metal charge. In addition, some oxidation of the elements in the charge occurs, particularly with a fine scrap charge and these contribute to the amount of slag. The flux should also aid in sulfur reduction and removal.

Fluxing furnishes a medium of a non-metallic liquid to absorb the extraneous material and produce a liquid slag containing these absorbed non-metallics providing the slag is sufficiently liquid at existing cupola operating temperatures. The liquid nature of the slag is required to avoid coating the coke with non-metallics and sticking the lumps of the coke together. The flux also provides a slag that will separate readily from the iron and permit ready removal of the non-metallics. The non-metallic material to be removed by fluxing is primarily silica, except for the lining contribution from neutral or basic operated cupolas; these materials usually exhibit a high melting point. With their high melting point, these non-metallic materials form a viscous or a pasty constituent in a cupola.

The viscous non-metallics exert several bad effects on a cupola operation. Exemplary of these are a slag formation which adheres to the coke and interferes with its burning. This decreases the cupola operation and reduces the carbon pick-up by remote droplets of metal. Further, the coke and metal coated with these non-metallics tend to stick together to cause the viscous nature of the surface to form a bridge or inter-connected solid layer across all or at least the outer portions of the cupola diameter. In effect, the viscous pasty slag fills the interstitial spaces in the coke and builds up a bridge in the areas chilled by air from the tuyeres. Many of the materials in the slag are acidic in character, which opposes absorption of sulfur into the slag so that an attempt is made to keep the flux basic to neutralize this acidity. Limestone is a popular material used for this purpose. Sodium carbonate is also widely used to assist in sulfur reduction because of its alkaline nature.

Fluorspar, a calcium fluoride mineral ($CaF_2$) is a powerful fluxing agent that is commonly used in small proportions along with limestone to improve slag fluidity. Fluorspar, while effective, has certain serious disadvantages. Specifically, fluorspar is relatively expensive and a high percentage of it must be imported. However, a more important disadvantage in connection with the use of fluorspar is its release of active fluorides as a gas upon decomposition in the cupola. The highly reactive properties of these gaseous fluorides are well known.

In connection with those cupola operations which have emission control systems using fiberglass bags as a filtration device, the gaseous fluorides attach the glass fibers. Some emission control systems utilize water for cooling the cupola shell and blast gases. The acid nature of fluorspar reduces the pH of the discharge water and increases the solubility of zinc compounds to such an extent that water pollution codes may be exceeded in this respect. Fluxes with a higher basicity will raise this pH and reduce zinc solubility.

It has been discovered by others that a combination of an alkali metal base and alumina, particularly gamma alumina, is capable of acting as a substitute for fluorspar as a cupola slag flux. This combination of ingredients at the elevated temperatures found in a cupola, e.g. about 1000° C., form within the cupola sodium aluminate which acts as well as fluorspar as a flux and does not interfere with the metallurgy of the iron-making process.

In U.S. Pat. No. 3,721,547 there is disclosed a briquetted cupola flux composition having the following composition:

30–60% calcium oxide;
5–25% alumina;
20–50% $Na_2O$; and
0–20% silica.

In this patent the chief source of alumina is Kyanite. It may be admixed with minor portions of Portland cement. It is evident that this particular flux composition contains substantial quantities of calcium oxide which, in the form of limestone, would tend to form in the cupola a mixture of calcium aluminate, sodium aluminate, and other simple inorganic compounds. While calcium aluminate has been used as a flux in iron-making processes, and is described in the literature, e.g. *The Making, Shaping and Treating of Steel,* United States Steel, Edited by Harold E. McGannon, Herbick & Held, 1971, it has not been used to any significant extent in cupola operations.

When an alkali metal base and a relatively pure alumina such as gamma alumina are formed into a briquette using conventional binders such as dextrin, sodium silicate, starch and the like, it forms a briquette having substantial green and room temperature dry strength.

When such briquettes are subjected to a temperature of about 1000° C., for about 1 hour, these briquettes mechanically lose their integrity and disintegrate into a powdery-type material. Such a briquette is incapable of being used as a cupola flux since upon disintegration, the powdery-like mass would be expelled from the cupola, hence negating the ability of the fluxing ingredients to combine with the slag and alter its physical characteristics.

Thus, it is obvious that in order for a cupola flux which contains an alkali metal base and alumina to be used as a flux in cupola operations, it must be in the form of a briquette or other solid shape which will maintain its mechanical integrity under the operating conditions of the cupola.

THE INVENTION

The invention is a flux for fluidizing slag in a cupola comprising a briquette which is composed of a major portion of alumina and an alkali metal base in an amount to provide an $Al_2O_3$:$Na_2O$ ratio ranging from 1:0.4 to 1:0.8 and from 5 up to 50% by weight of a binder from the group consisting of a montmorillonite clay, alumino silicate zeolites, sodium aluminate and aluminum phosphate. The briquette is characterized as being able to substantially maintain its physical integrity at 1000° C. for about 1 hour.

In a preferred embodiment of the invention, the $Al_2O_3$:$Na_2O$ ratio is 1:0.61. The amount of binder is preferably within the range of 10–50% and, most preferably, within the range of 10–30%.

THE ALUMINA

The alumina is preferably a relatively pure form of alumina such as gamma alumina which is available commercially from many sources of supply. It should be in the form of a finely divided powder and should be relatively free of mechanically bound water.

THE ALKALI METAL BASE

The alkali metal base is a term which, as used herein and in the claims, refers to an inorganic base which contains sodium. It is preferably either sodium carbonate or sodium hydroxide.

THE BINDERS

Clays

The preferred binder is an inorganic clay which is substantially free of calcium and contains substantial portions of alumina. A preferred group of binders are the well-known montmorillonite clays. Of this group of clays, bentonite clay, particularly sodium bentonite, is preferred. For additional clays, see the *Encyclopedia of Chemical Technology,* Vol. 5 at page 547.

Inorganic Zeolite Gels

These materials are formed by reacting a water-soluble alumina compound with a water-soluble silicate or silica sol to produce an alumina silicate gel. Usually, the $Na_2O$:$Al_2O_3$ ratio is about 1:1 but may vary between 1:2 to as high as 1:15. A typical method of preparing these zeolite gels is to react sodium aluminate or aluminum sulfate with sodium silicate in the form of aqueous solutions to form a gel which may be subsequently dried. This technique is well known. Zeolites of this type are described in greater detail in U.S. Pat. Nos. 1,906,202 and 2,877,716.

Sodium Aluminate

Sodium aluminate is produced commercially by digesting alumina or an alumina-containing mineral, e.g. bauxite, with concentrated caustic solutions. Digested alumina may be dried to produce a pulverulent material. A commercial sodium aluminate of this type is sold by Nalco Chemical Company under the brand name, Nalco 680.

Aluminum Phosphate

Aluminum phosphate is a well-known binder for many ceramic applications. Its mode of preparation and composition is described in U.S. Pat. No. 2,460,344.

Binder Adjuvants

When the binders of the type described above, particularly sodium bentonite, is used in the amount ranging from 10–50%, it has been found that approximately between 10–30% by weight of the binder may be replaced with certain binder extenders. These extenders may be either sodium silicate, e.g. waterglass, or finely divided silica flour (beach sand). These two materials may not be substituted in toto for the binders used in the invention since they have been tested as binders per se and are inoperative.

The Preparation of the Briquettes

The briquettes may be in any physical form. Thus, balls, bricks, semi-rectangular or square shapes, cylinders, tablets and the like all may be used. The method of preparing the briquettes from a mechanical standpoint is well known to the art and need not be described in any further detail. A convenient method of preparing the briquettes is to use mechanical briquetting machinery of the type used to produce charcoal briquettes. In a commercial embodiment of the present invention, so-called "ball-briquettes" are prepared utilizing ball-shaped steam-injected molds. The finished product is a hard, dense, ball-briquette having a diameter of approximately 3". These briquette machines operate at a pressure of 75 tons and have a skin temperature of between 225°–250° F.

In briquetting compositions of the type described herein, it is sometimes desirable to incorporate therewith minor amounts of water to render the powdery material plastic and workable prior to briquetting. Also, it is beneficial to add up to 10% by weight based on the total weight of the composition of organic binders such as starch, dextrin, and the like to provide green strength for the briquettes at the time they are manufactured.

In formulating the ingredients used in preparing the briquettes, it is desirable that the total $SiO_2$ content of the briquette does not exceed about 30% by weight since excessive silica tends to react with the iron in the cupola and change the metallurgical composition of the iron.

EXAMPLES

To illustrate the invention, the following is presented by way of example:

Briquettes were made with the ingredients listed in Table I. After mixing the solid ingredients, water and/or silicate solution were added and the materials were molded into 3" diameter size balls and dried. The balls were all fired in a 1000° C. furnace for 1 hour to test their stability. All showed excellent stability unless otherwise noted for 1 hour at this temperature.

The examples in Table I illustrate several embodiments of the invention.

TABLE I

| Example | Weight Percentages | | | | | | | Remarks |
|---|---|---|---|---|---|---|---|---|
| | Calcined Alumina[1] | Bentonite Clay[2] | Sodium Carbonate | Dextrin | Sodium Silicate[3] | Silica[4] | Water | |
| 1 | 38.8 | | 40.3 | 4.2 | | 4.2 | 12.5 | Powder--did not contain clay. |
| 2 | 34.2 | 12.7 | 38.2 | 2.0 | | | 12.8 | |
| 3 | 31.0 | 14.0 | 35.0 | 8.0 | | | 12.0 | |
| 4 | 36.8 | | 38.3 | 4.1 | | 8.3 | 12.5 | |
| 5 | 26.6 | 9.8 | 29.8 | | 31.4 | | 2.4 | |
| 6 | 23.1 | 27.2 | 29.7 | 8.0 | | | 12.0 | |
| 7 | 25.6 | 28.8 | 32.6 | | | | 13.0 | |
| 8 | 31.4 | | 32.6 | 8.0 | | 16.0 | 12.0 | Crumbles, contains no clay. |
| 9 | 25.3 | 9.2 | 28.2 | | 29.8 | 5.1 | 2.4 | Improved stability compared to 8. |
| 10 | 16.0 | 39.2 | 24.8 | 8.0 | | | 12.0 | |
| 11 | 22.5 | 8.3 | 25.2 | | 26.6 | 15.0 | 2.4 | Some splitting of the "ball" occurred when heated to 1000° C. |
| 12 | 23.7 | 29.7 | 30.8 | 5.9 | | | 9.9 | |
| 13 | 22.4 | 28.0 | 29.1 | 7.8 | | | 12.7 | |
| 14 | 22.4 | 28.0 | 29.1 | 7.8 | | | 12.7 | |
| 15 | 26.2 | 10.5 | 29.3 | | 31.4 | | 2.6 | Some splitting of the "ball" occurred when heated to 1000° C. |
| 16 | 26.6 | 10.6 | 29.8 | 3.7 | 26.6 | | 2.7 | |
| 17 | 27.8 | 11.1 | 31.2 | 3.9 | 22.3 | | 3.7 | |

[1]Calcined alumina: alumina powder, high in gamma alumina, low in alpha alumina.
[2]Bentonite clay: x-ray analysis of this material shows it to be: 55.4% Si as $SiO_2$, 20.1% Al as $Al_2O_3$, 3.6% Fe as $Fe_2O_3$, 2.0% MgO, 2.7% $Na_2O$, 5.5% $H_2O$.
[3]Sodium silicate: an aqueous solution containing 32% by weight solids, 28% as $SiO_2$.
[4]Silica: a 200 mesh (Tyler) silica flour.

I claim:

1. A flux for fluidizing slag in a cupola comprising a briquette which is composed of a major portion of alumina and an alkali metal base in an amount to provide an $Al_2O_3$:$Na_2O$ ratio ranging from 1:0.4 to 1:0.8 and from 5 up to 50% by weight of a binder from the group consisting of a montmorillonite clay, alumino silicate zeolites, sodium aluminate and aluminum phosphate, said briquette being characterized as being able to substantially maintain its physical integrity at about 1000° C. for about 1 hour.

2. The flux of claim 1 where the binder is bentonite clay and it is present in an amount ranging from 10–50% by weight.

3. The flux of claim 2 where the bentonite clay is present in an amount ranging from 10–30% by weight.

4. The flux of claim 2 where from 10–30% of the bentonite is replaced with either waterglass or silica flour.

* * * * *